US006247955B1

(12) United States Patent
Yoshida et al.

(10) Patent No.: US 6,247,955 B1
(45) Date of Patent: Jun. 19, 2001

(54) HALF-FITTING PREVENTION CONNECTOR

(75) Inventors: Haruki Yoshida; Shigeru Tanaka, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/389,587

(22) Filed: Sep. 3, 1999

(30) Foreign Application Priority Data

Sep. 8, 1998 (JP) ..... 10-254119

(51) Int. Cl.[7] ..... H01R 13/627
(52) U.S. Cl. ..... 439/352
(58) Field of Search ..... 439/352

(56) References Cited

U.S. PATENT DOCUMENTS

| | | | |
|---|---|---|---|
| 5,718,596 | 2/1998 | Inaba et al. | 439/352 |
| 5,820,399 | 10/1998 | Shirouzu et al. | 439/352 |

FOREIGN PATENT DOCUMENTS

| | | |
|---|---|---|
| 32 47 022 C2 | 8/1988 | (DE) . |
| 197 33 893 A1 | 2/1998 | (DE) . |
| 199 40 489 A1 | 3/2000 | (DE) . |
| 2 0 896 396 | 2/1999 | (EP) . |
| 2 324 209 | 10/1998 | (GB) . |
| 9-134757 | 5/1997 | (JP) . |
| 11-224728 | 8/1999 | (JP) . |

*Primary Examiner*—Tulsidas Patel
*Assistant Examiner*—Javaid Nasri
(74) *Attorney, Agent, or Firm*—Sughrue, Mion, Zinn, Macpeak & Seas, PLLC

(57) ABSTRACT

A half-fitting prevention connector (1) includes a first connector (2) and a second connector (3). The first connector (2) has an engagement groove (7) and retaining projections (8) provided at a front end portion thereof. The second connector (3) includes a housing body (4) and a slider (5) slidably mounted within the housing body (4). The housing body (4) includes an elastic lock arm (10) having at its front end a lock portion (9) for engagement in the engagement groove (7), and the slider (5) is resiliently urged in an axial direction, and has an elastic cantilever arm (12), and abutment portions (11) for abutting engagement respectively with the retaining projections (8) are formed at a front end of the cantilever arm (12). An abutment surface of each retaining projection (8) are both formed into substantially-arcuate surfaces, substantially disposed on an imaginary circle (A) having its center disposed on an axis (C) of flexing of the cantilever arm (12).

3 Claims, 9 Drawing Sheets

HALF-FITTING PREVENTION CONNECTOR

BACKGROUND OF THE INVENTION

1. Field of the Invention

The present invention relates to a half-fitting prevention connector, used to electrically connect wire harnesses in an automobile and others, in which a half-fitted condition is prevented by a resilient force of a resilient member, and also damage to the connector is prevented.

The present application is based on Japanese Patent Application No. Hei. 10-254119, which is incorporated herein by reference.

2. Description of the Related Art

Various half-fitting prevention connectors have heretofore been known. For example, a half-fitting prevention connector, disclosed in Unexamined Japanese Patent Publication No. Hei. 9-134757, will be described.

As shown in FIG. 8, the related half-fitting prevention connector 61 comprises a first connector 62, in which connector terminals 78, connected respectively to wires of a wire harness, are mounted, and a second connector 63 in which connector terminals 79 for contact respectively with the connector terminals 78 are mounted. The second connector 63 comprises a housing body 64, and a slider 65 which is attached to the outer periphery of the housing body 64 for sliding movement in an axial direction, and is resiliently urged forward.

An engagement groove 67 and a retaining projection 68 are provided at a front end portion of a housing of the first connector 62, and an elastic lock arm 70, having a lock portion 69 for engagement in the engagement groove 67, is provided at a front end portion of the housing of the second connector 63.

The slider 65 is resiliently urged forward in the axial direction so as to control the flexing (elastic deformation) of the lock arm 70 and also to prevent a half-fitted condition, and an abutment portion 71 for abutting engagement with the retaining projection 68 is provided at the front end of the slider 65. This abutment portion 71 is provided at a cantilever arm 72 connected to a rear end portion of the slider 65, and this cantilever arm 72 can be elastically deformed outwardly, and has a rectangular slide hole 73 formed through a central portion thereof.

A cantilever arm-pressing projection 74 is formed at that portion of the housing body 64 corresponding to the slide hole 73. The male connector terminals 78 project into an internal space 75 of the first connector, and the female connector terminals 79 are received respectively in terminal receiving chambers 76 in the housing body 64.

In the half-fitting connector 61 of the above construction, as the first and second connectors 62 and 63 are fitted together as shown in FIG. 9, the abutment portion 71, formed at the distal end of the cantilever arm 72 formed on the slider 65, is first brought into abutting engagement with the retaining projection 68 formed on the housing 66 of the first connector 62.

Then, when the housing body 64 of the second connector 63 is further pushed in the fitting direction, only the housing body 64 advances in the fitting direction, with the slider 65 kept stopped. As a result, the front portion of the lock arm 70 is exposed from the slider 65, and therefore can be flexed upwardly as shown in FIG. 10. Then, when the housing body 64 is further pushed, the lock portion 69 slides onto the front end portion of the mating housing 66.

Then, immediately before the lock portion 69 is brought into engagement in the engagement groove 67, the cantilever arm-pressing projection 74 presses the abutment portion 71 to cancel the retaining engagement of the abutment portion 71 with the retaining projection 68 as shown in FIG. 11, and therefore the lock portion 69 is engaged in the engagement groove 67, and at the same time the slider 65 advances under the influence of the resilient force to cover the lock portion 69, thereby preventing the disengagement of the lock portion.

If the fitting force is removed before the abutment portion 71 is disengaged from the engagement projection 68, the housing body 64 is pushed back in an anti-fitting direction under the influence of the resilient force acting on the slider 65. Therefore, such a half-fitted condition of the two connectors can be easily detected.

For canceling the fitted condition of the first and second connectors 62 and 63, the slider 65 is returned rearward, and as a result, the housing body 64 is also returned since a slide range-limiting mechanism (not shown) is provided between the slider 65 and the housing body 64. At this time, the lock portion 69 is not covered with the slider 65, and the lock portion 69 has a rear slanting surface, and therefore the lock portion 69 is disengaged from the engagement groove 67 while flexing the lock arm 70 outwardly. When the slider 65 is released after the first and second connectors 62 and 63 are disconnected from each other, the slider 65 is moved in the disconnecting direction under the influence of the resilient force.

However, in the above half-fitting prevention connector 61, when the abutment portion 71 of the slider 65 is to be disengaged from the retaining projection 68 during the fitting operation as shown in FIG. 11, the cantilever arm 72 is flexed about a flexing axis C as shown in FIG. 12. In this case, if an abutment surface 71*a* of the abutment portion 71 and a retaining surface (abutment surface) 68*a* of the retaining projection 68 are both vertical, one or both of the two is subjected to chipping or deformation at a lap portion L, thus inviting a problem that the reliability and durability are much lowered.

And besides, the cantilever arm 72 is formed on the slider 65 slidably attached to the outer periphery of the housing body 64, and therefore there is a possibility that the slider is deformed or damaged upon accidental impingement of an external object, which leads to a malfunction, and this results in a problem that the reliability and durability are further lowered.

SUMMARY OF THE INVENTION

With the above problems in view, it is an object of the present invention to provide a half-fitting prevention connector in which part of a housing is prevented from deformation and damage during a fitting operation, and a malfunction due to an accidentally-impinging object is prevented, thereby achieving excellent reliability and durability.

To achieve the above object, according to the first aspect of the present invention, there is provided a half-fitting prevention connector which comprises a first connector including a first housing having an engagement groove and a retaining projection which are provided at a front end portion of the first housing, a second connector fittable to the first connector, the second connector including a second housing having an elastic lock arm, a front end of the elastic lock arm having a lock portion engaged with the engagement groove of the first housing when the first connector is fitted to the second connector, a slider attachable to the second housing, the slider being resiliently urged in an axial direction thereof when the slider is attached to the second housing, the slider including an elastic cantilever arm, and an abutment portion formed at a front end of the cantilever arm of the slider, the abutment portion having an abutment surface which abuts against an abutment surface of the retaining projection of the first housing when the first connector is fitted to the second connector. In the half-fitting prevention connector, the abutment surface of the abutment portion and the abutment surface of the retaining projection are substantially slanting surfaces which are substantially formed along an imaginary circle having its center at the axis of flexing of the cantilever arm. In other words, the abutment surface of the abutment portion and the abutment surface of the retaining projection are formed substantially in conformance with a locus of the flexing of the front end of the cantilever arm.

Therefore, when the abutment portion of the slider, abutted against the retaining projection, is to be disengaged therefrom during the fitting operation, there is no interfering lap portion between these abutment surfaces, and the two surfaces can smoothly slide relative to each other. Therefore, deformation and damage will not develop, and the reliability and durability can be enhanced.

In the above half-fitting prevention connector, preferably, the slider is attachable to the second housing so that the slider is received within the second housing.

Therefore, deformation and damage by an accidentally-impinging object can be positively prevented. Accordingly, a malfunction due to deformation and damage is prevented, and the reliability and durability can be further enhanced.

DETAILED DESCRIPTION OF THE PREFERRED EMBODIMENT

One preferred embodiment of a half-fitting prevention connector of the present invention will now be described in detail with reference to FIGS. 1 to 7.

Figure 1:
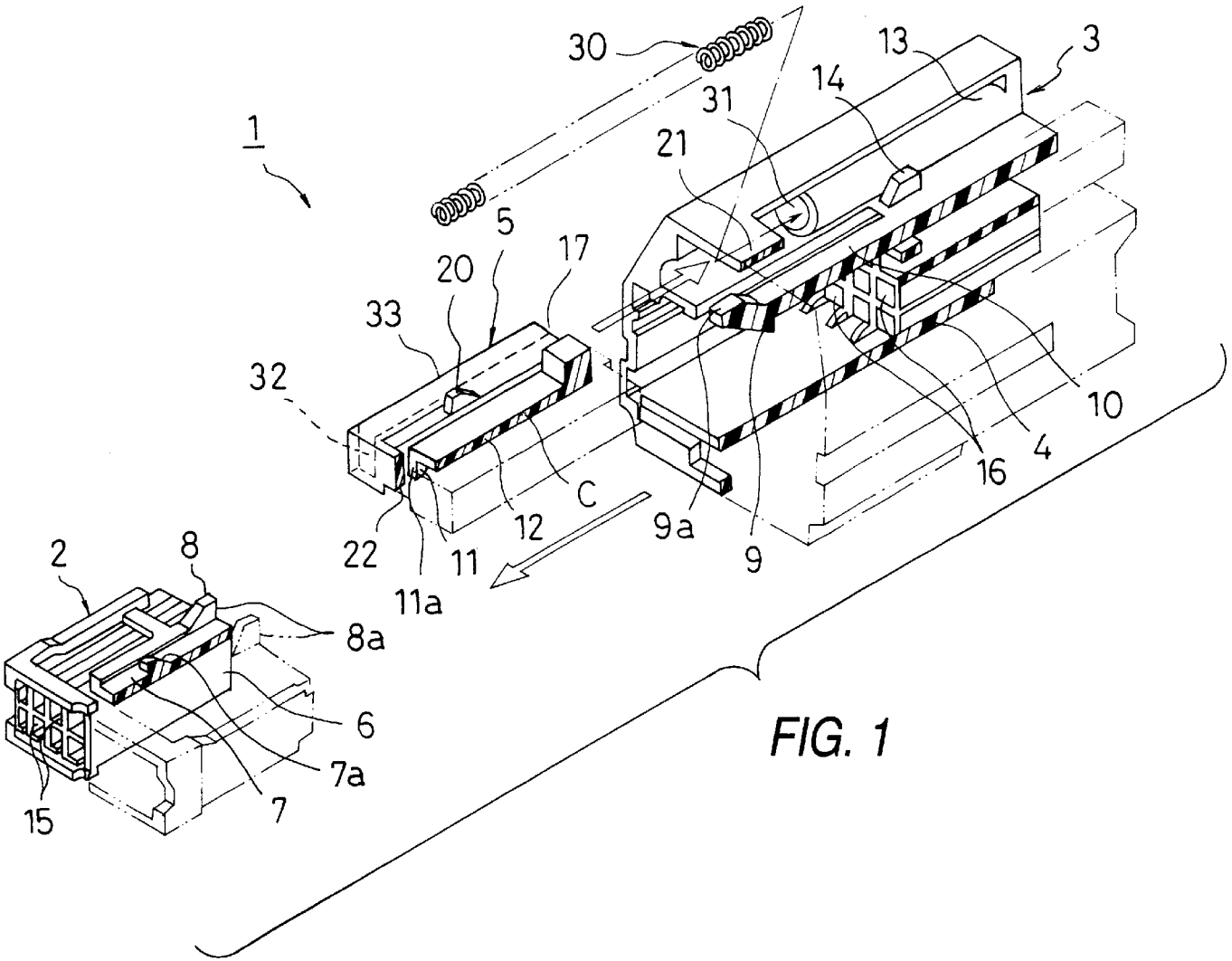
FIG. 1 is an exploded, perspective view of one preferred embodiment of a half-fitting prevention connector of the present invention.

As shown in FIG. 1, the half-fitting prevention connector 1 comprises a first connector 2, having an engagement groove 7 and retaining projections 8 provided at a front end portion of a housing 6, and a second connector 3 including a housing body 4 and a slider 5 slidable within the housing body 4. The housing body 4 includes an elastic lock arm 10 having at its front end a lock portion 9 for engagement in the engagement groove 7. The slider 5 is resiliently urged in the axial direction by compression springs 30 so as to control the flexing (elastic deformation) of the lock arm 10 and also to prevent a half-fitted condition. The slider 5 has an elastic cantilever arm 12 at its central portion, and abutment portions 11 for abutting engagement respectively with the retaining projections 8 are formed on and project downwardly from a front end of the cantilever arm 12.

In the half-fitting prevention connector of this embodiment, abutment surfaces 11*a* of the abutment portions 11 and retaining surfaces (abutment surfaces) 8*a* of the retaining projections 8 are formed either into arcuate (arc-shaped) surfaces, disposed on an imaginary circle A having its center disposed on an axis C of flexing of the cantilever arm 12, or into substantially-arcuate slanting surfaces close to the arcuate surfaces of the imaginary circle A.

The slider 5 is received within the housing body 4, and the cantilever arm 12 is provided at the central portion of the slider 5 in spaced relation of an upper surface of the slider 5.

More specifically, one engagement groove 7 is formed in the upper surface of the housing 6 of the first connector 2, and the pair of retaining projections 8 and 8 are formed on the front portion of this upper surface. A plurality of female connector terminals 18 are received respectively in terminal receiving chambers 15.

One elastic lock arm 10, having one lock portion 9 for engagement in the engagement groove 7, is formed at a central portion of the front end portion of the housing body 4. A pair of abutment portion-pressing projections 14 and 14 for respectively lifting the abutment portions 11 while flexing the cantilever arm 12 are formed at a proximal end portion of the lock arm 10.

A plurality of terminal receiving chambers 16 are formed below the lock arm 10, and a plurality of male connector terminals 19 are received respectively in these terminal receiving chambers. A pair of spring receiving chambers 31 and 31 are provided adjacent to the outer sides of the abutment portion-pressing projections 14, respectively, and the compression springs 30 are received respectively in these spring receiving chambers. A pair of slide guide grooves 13 and 13 are provided above the spring receiving chambers 31, respectively, and extend in the longitudinal direction. A stop plate 21 for limiting the movement of the front end of the slider 5 is formed at the front end of the upper side of the housing body. A disengagement prevention projection 9*a* for preventing accidental cancellation of a locked condition is formed on the upper surface of the lock portion 9 formed at the front end of the lock arm 10.

An operating portion 17 is formed on the rear end of the slider 5, and when disconnecting the two connectors from each other, the slider 5 is pulled in an anti-fitting direction through this operating portion 17. Guide portions 33 are formed respectively at opposite side portions of the upper portion of the slider, and extend from its rear end to its front end, and these guide portions 33 are guided respectively by the slider guide grooves 13 so that the slider can slide forward and rearward. Stop projections 22 are formed on the upper surface of the slider 5, and can abut against the stop plate 21 of the housing body 4, thereby limiting the movement of the slider 5.

Spring retaining plates 32 are provided respectively at the front ends of the guide portions 33, and the front ends of the compression springs 30 are abutted respectively against these plates 32. A disengagement prevention plate 22 is provided at the front end of the slider 5, and interconnects the pair of spring retaining plates 32, and this disengagement prevention plate 22 covers the lock portion 9 from the upper side so that the lock portion 9 will not be disengaged from the engagement groove 7.

Figure 2:
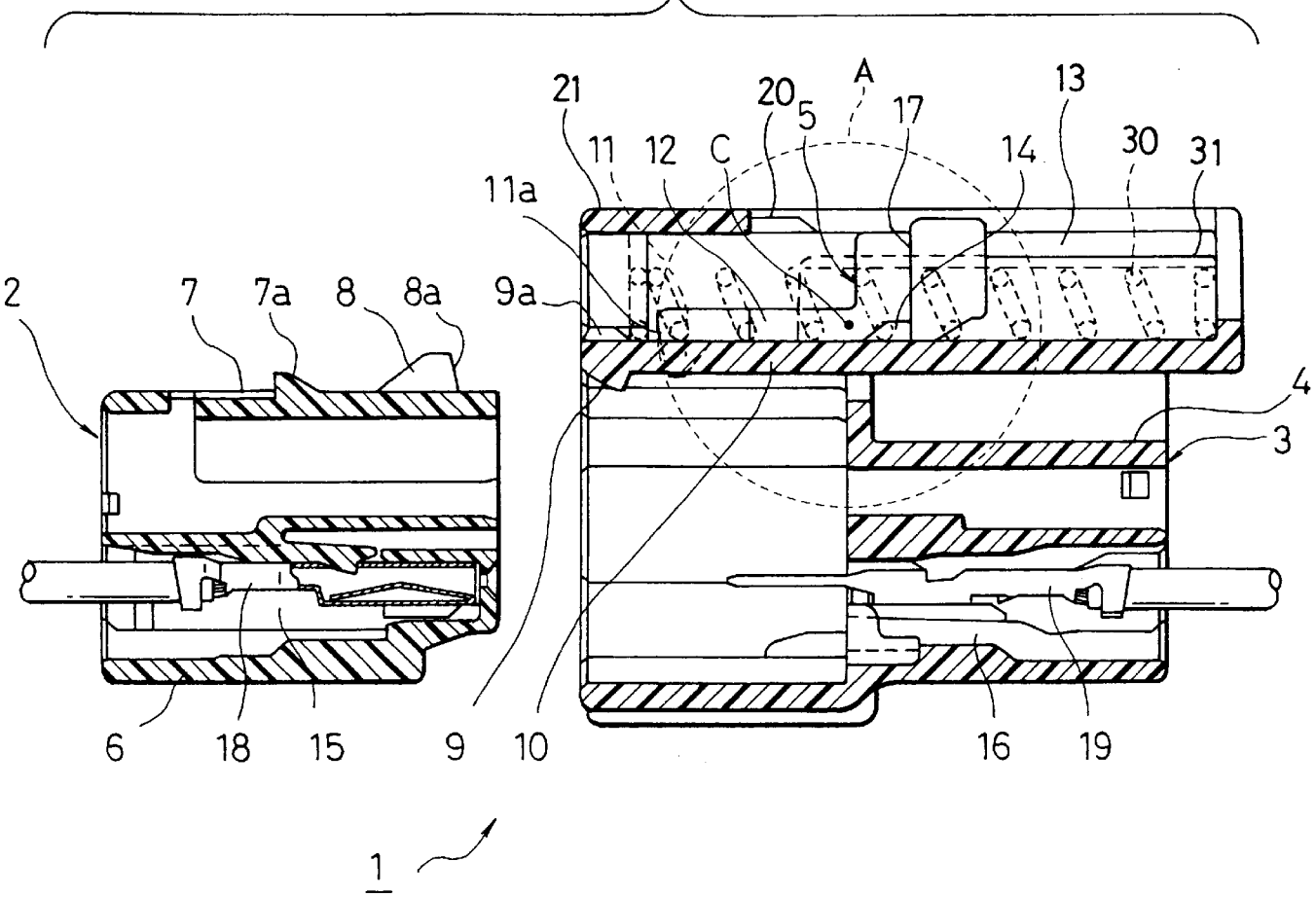
FIG. 2 is a vertical cross-sectional view of the connector of FIG. 1, showing a condition before a fitting operation is started.

In the half-fitting prevention connector 1 of the above construction, as shown in FIGS. 1 and 2, the plurality of female terminals 18 each connected to a wire are inserted respectively into the terminal receiving chambers 15 in the first connector 2, and the plurality of male terminals 19 each connected to a wire are inserted respectively into the terminal receiving chambers 16 in the second connector 3. Then, the compression springs 30 are inserted respectively into the spring receiving chambers 31 in the second connector 3, and thereafter the slider 5 is inserted into the housing body 4 while being guided by the slider guide grooves 13. At this time, the slider is inserted while rear slanting surfaces of the stop projections 20 flex the stop plate 21, and the front end surfaces of the stop projections 20 abut against the rear edge of the stop plate 21, thereby determining the position of the front end of the slider 5.

Figure 3:
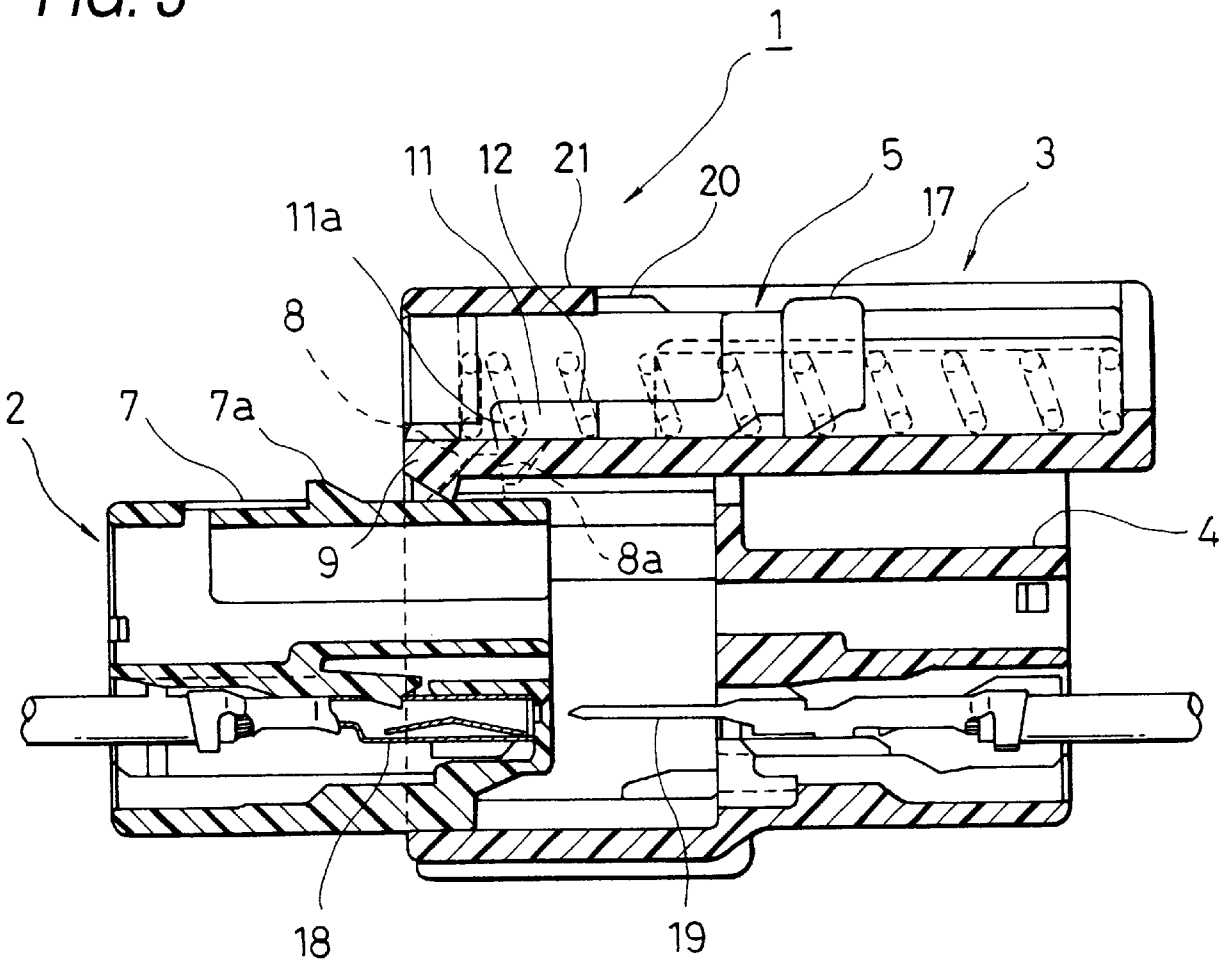
FIG. 3 is a view explanatory of the operation of the connector of FIG. 1, showing a condition when the fitting operation is started.

Next, the operation for fitting the first and second connectors 2 and 3 together will be described. As shown in FIG. 3, when the first and second connectors 2 and 3 begin to be fitted together, the abutment surfaces 11*a* of the abutment portions 11, formed on the slider 5, abut respectively against the retaining surfaces 8*a* of the retaining projections 8 formed on the housing 6 of the first connector 2. When the housing 6 of the first connector 2 is further pushed in the fitting direction, the slider 5 is moved toward the rear end of the housing body 4 against the bias of the compression springs 30, as shown in FIG. 4.

Figure 4:
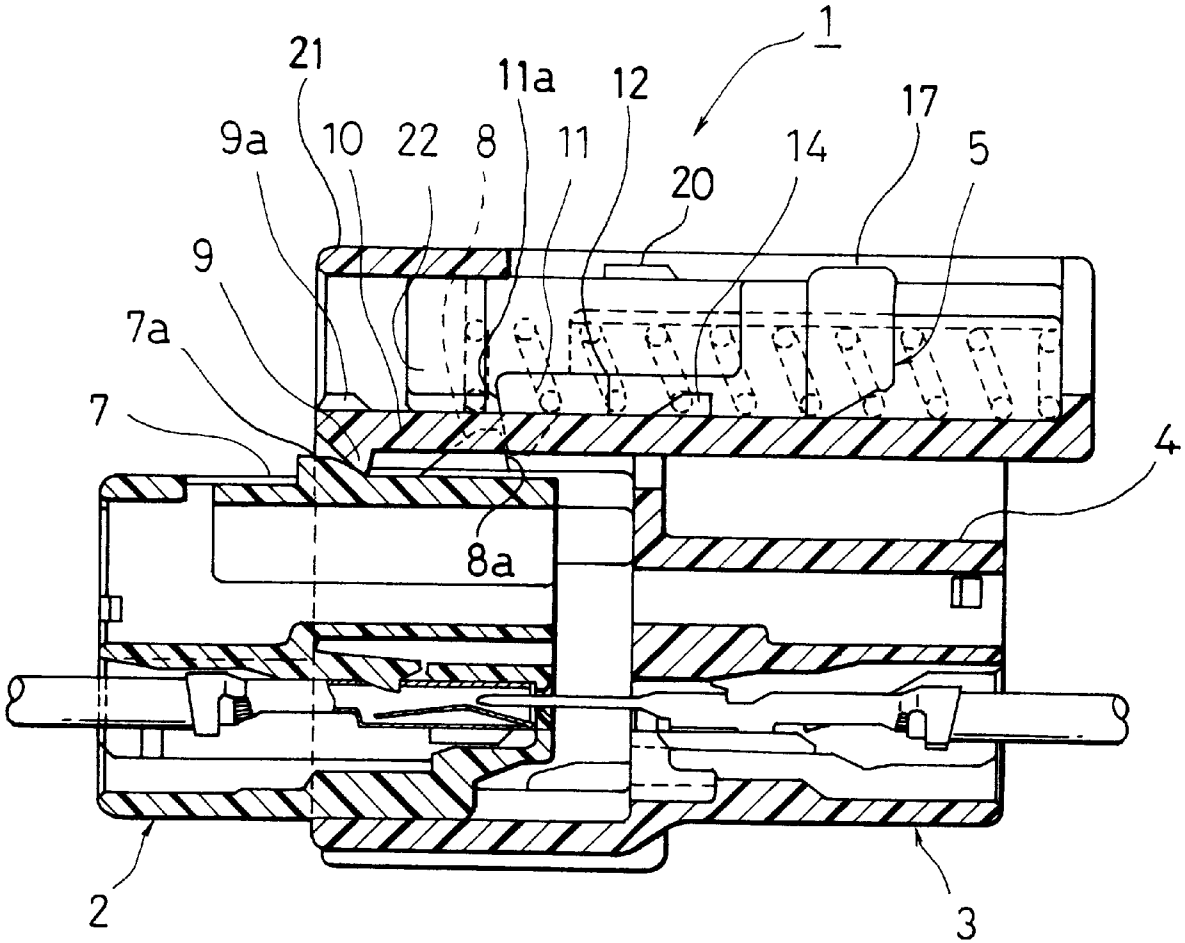
FIG. 4 is a view explanatory of the operation of the connector of FIG. 1, showing a condition during the fitting operation.
Figure 5:
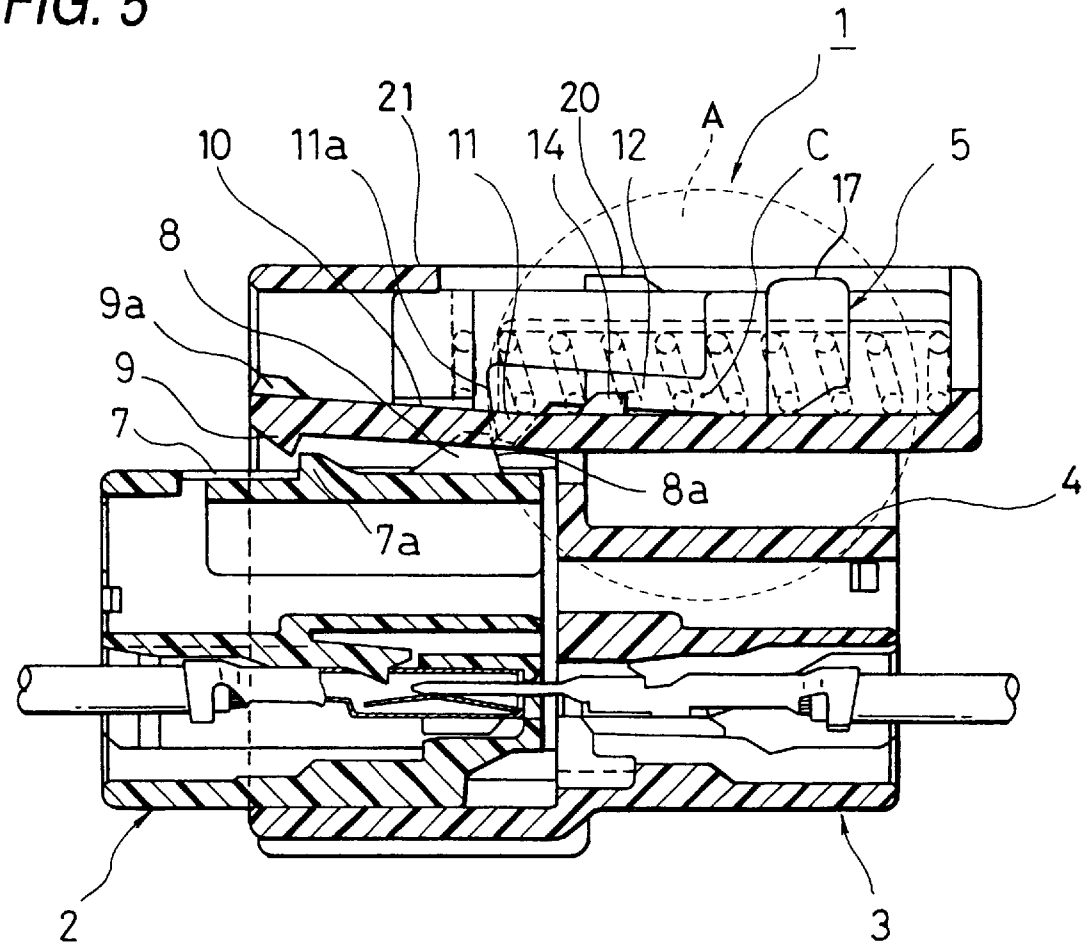
FIG. 5 is a view explanatory of the operation of the connector of FIG. 1, showing a condition before the fitting operation is completed.

As a result, a front slanting surface of an engagement projection 7*a* abuts against a front slanting surface of the lock portion 9 to press the lock portion 9 upward, so that the lock arm 10 is flexed upwardly, as shown in FIGS. 4 and 5. Then, the lock portion 9 slides over the engagement projection 7*a* of the mating housing 6, and is engaged in the engagement groove 7.

Figure 6:
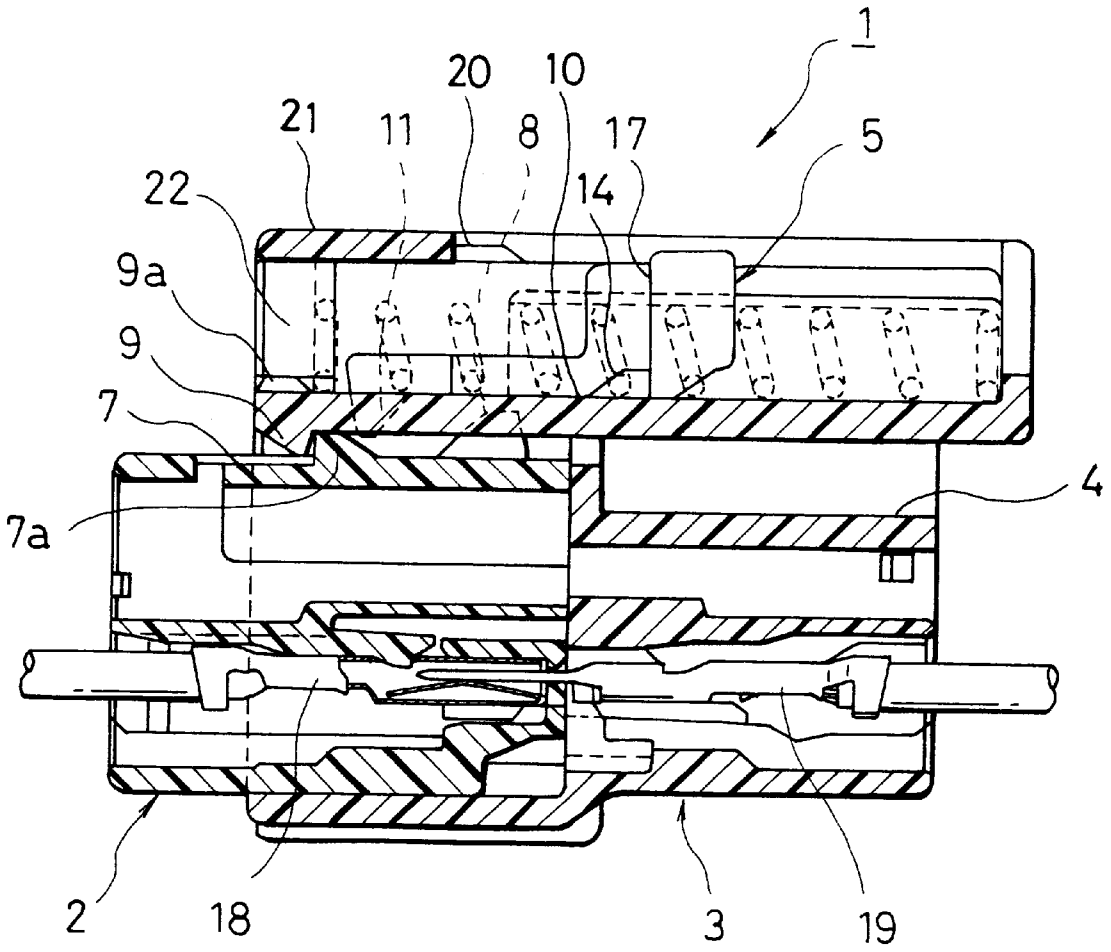
FIG. 6 is a view explanatory of the operation of the connector of FIG. 1, showing a condition in which the fitting operation is completed.

At this time, front slanting surfaces of the abutment portion-pressing projections 14 abut respectively against rear end surfaces of the abutment portions 11, so that the cantilever arm 12 of the slider 5 is pressed and flexed upwardly, as shown in FIG. 5. As a result, the abutment surface 11*a* of each abutment portion 11, abutted against the associated retaining projection 8, is urged upward to slide on the retaining surface 8*a*. As a result, the slider 5 is moved to the foremost position in the housing body 4 by the resilient force of the compression springs 30 as shown in FIG. 6. The disengagement prevention plate 22 holds the disengagement prevention projection 9*a*, formed at the front end of the lock arm 10, from the upper side, thereby preventing the engaged condition from being canceled by vibrations and so on. Thus, the operation for fitting the first and second connectors 2 and 3 is completed.

If the pushing force is removed before the abutting engagement of the abutment portions 11 with the retaining projections 8 is canceled, the housing body 4 is pushed back away from the housing 6 by the resilient force of the compression springs 30 into a position where the female and male terminals are not completely electrically connected together. Therefore, a half-fitted condition of the first and second connectors 2 and 3 can be positively detected.

For canceling the fitted condition of the first and second connectors 2 and 3, the finger is engaged with the operating portion 17, and is pulled in the anti-fitting direction against the bias of the compression springs 30. As a result, the disengagement prevention plate 22 slides rearwardly over the disengagement prevention projection 9*a*, so that the lock arm 10 can be flexed upwardly. In this condition, when the housing 6 of the first connector 6 is pulled, the engagement projection 7*a* on the first connector 2 can slide over the lock portion 9 because of the formation of the rear slanting surface of the lock portion 9, and therefore the first connector 2 is withdrawn from the second connector 3.

Figure 7:
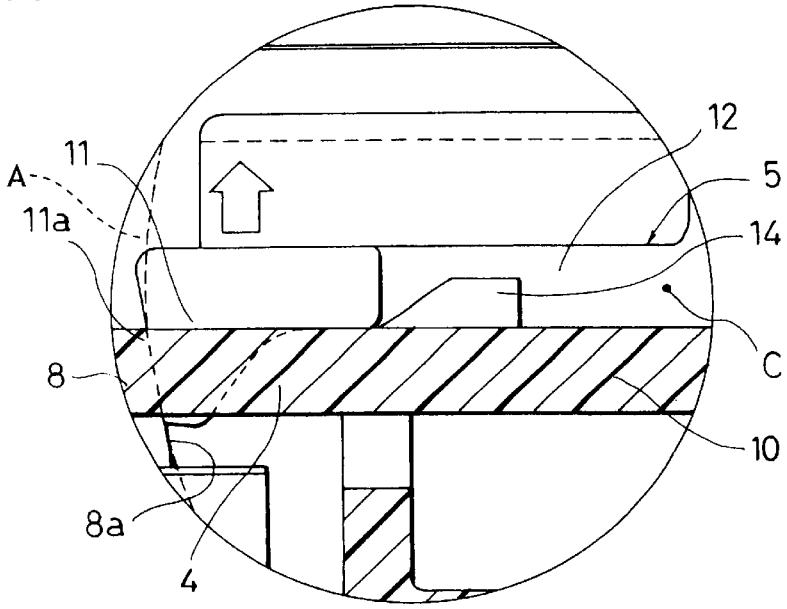
FIG. 7 is an enlarged, fragmentary view showing an abutment portion of FIG. 5 and its neighboring portions.
Figure 8:
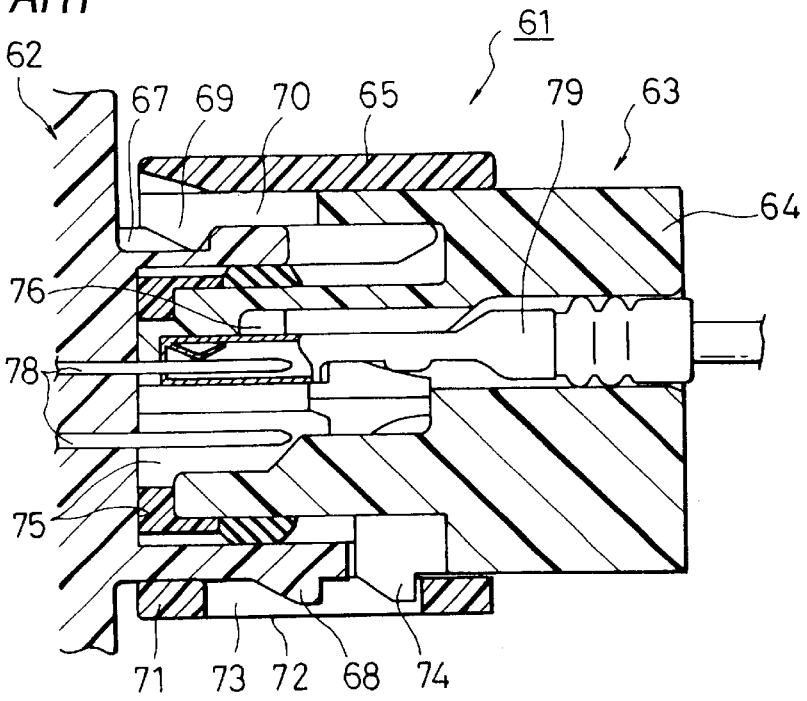
FIG. 8 PRIOR ART
FIG. 8 is a vertical cross-sectional view of a conventional half-fitting prevention connector.
Figure 9:
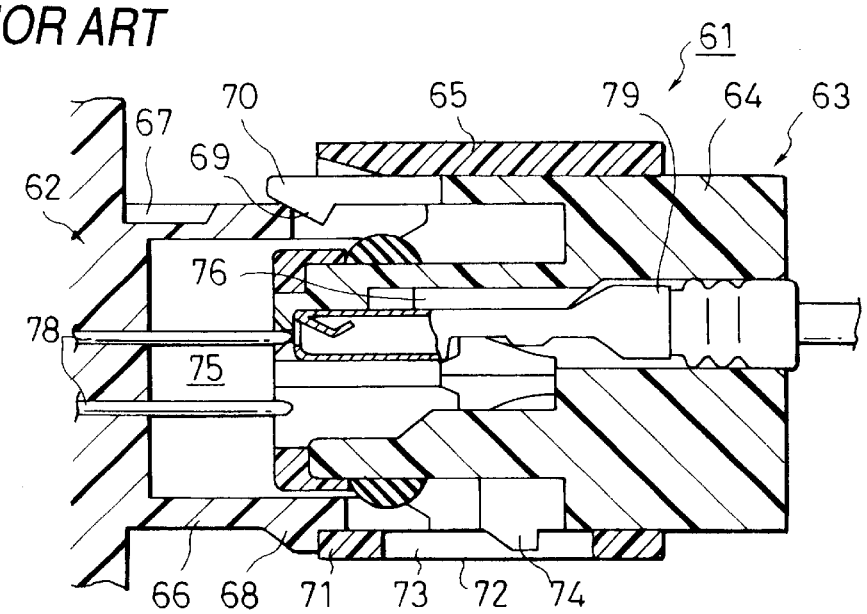
FIG. 9 PRIOR ART
FIG. 9 is a view explanatory of the operation of the conventional connector of FIG. 8, showing a condition when the fitting operation is started.
Figure 10:
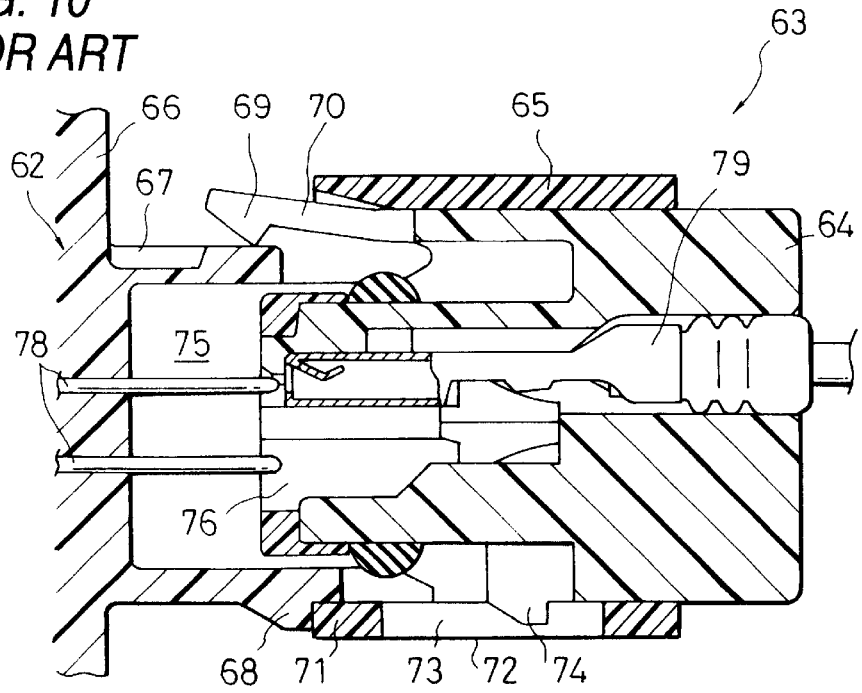
FIG. 10 PRIOR ART
FIG. 10 is a view explanatory of the operation of the conventional connector of FIG. 8, showing a condition during the fitting operation.
Figure 11:
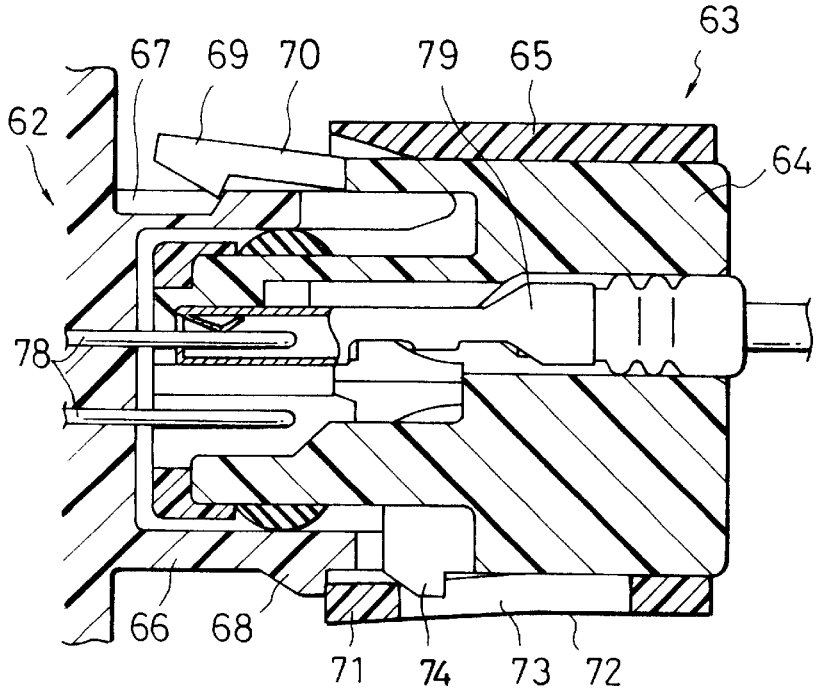
FIG. 11 PRIOR ART
FIG. 11 is a view explanatory of the operation of the conventional connector of FIG. 8, showing a condition in which the fitting operation is completed.
Figure 12:
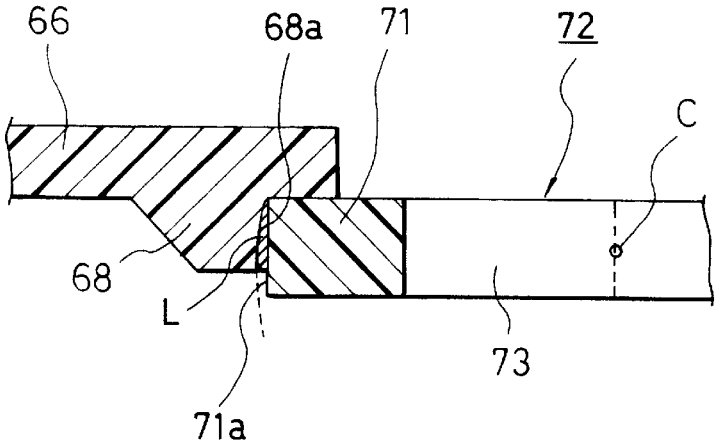
FIG. 12 PRIOR ART
FIG. 12 is an enlarged, fragmentary view showing a condition in which an abutment portion of FIG. 8 is to be disengaged from a retaining projection.

In the above half-fitting prevention connector 1, as shown in FIG. 7, the abutment portion 11 and the retaining surface 8*a* of each retaining projection 8 are both formed into substantially arcuate (arc-shaped) surfaces, substantially disposed on an imaginary circle A having its center disposed on the axis C of flexing of the cantilever arm 12. Therefore, when the abutment portion 11 of the slider 5, abutted against the retaining projection 8, is to be disengaged therefrom during the fitting operation, abutment surface 11*a* and the retaining surface 8*a*, and the two surfaces can smoothly slide relative to each other. Therefore, deformation and damage will not develop, and the reliability and durability can be enhanced.

The slider 5 is received within the housing body 4, and the abutment portions 11 of the cantilever arm 12 is disposed at a level below the upper surface, and therefore deformation and damage by an accidentally-impinging object can be prevented. Therefore, a malfunction due to deformation and damage is not encountered, and the reliability and durability can be further enhanced.

The half-fitting prevention connector of the present invention is not limited to the above embodiment, and suitable modifications can be made. For example, in the above embodiment, although one lock arm 10, having one lock portion 9, is provided at the central portion, a pair of lock arms can be provided at the opposite side portions, respectively, in which case the arrangement of the engagement groove 7 and the engagement projection 7*a* of the mating connector 2 is suitably changed. Although the female connector terminals 18 are received in the housing 6 while the male connector terminals 19 are received in the housing body 4, this arrangement may be reversed, in which case the terminal receiving chambers 15 and 16 are changed in configuration.

As described above, in the half-fitting prevention connector of the present invention, the abutment surface of each abutment portion and the abutment surface of each retaining projection are both formed into substantially-arcuate surfaces, substantially disposed on an imaginary circle having its center disposed on the axis of flexing of the cantilever arm. Therefore, when the abutment portion of the slider, abutted against the retaining projection, is to be disengaged therefrom during the fitting operation, there is no interfering lap portion between these abutment surfaces, and the two surfaces can smoothly slide relative to each other. Therefore, deformation and damage will not develop, and the reliability and durability can be enhanced.

And besides, the slider is received within the housing body, and therefore deformation and damage by an accidentally-impinging object can be positively prevented, and therefore a malfunction due to deformation and damage is prevented, and the reliability and durability can be further enhanced.

What is claimed is:

1. A half-fitting prevention connector, comprising:

a first connector including a first housing having an engagement groove and a retaining projection which are provided at a front end portion of the first housing;

a second connector fittable to the first connector, the second connector including a second housing having an elastic lock arm, a front end of the elastic lock arm having a lock portion engageable with the engagement groove of the first housing when the first connector is fitted to the second connector;

a slider attachable to the second housing, the slider being resiliently urged in an axial direction thereof when the slider is attached to the second housing, the slider including an elastic cantilever arm; and an abutment portion formed at a front end of the cantilever arm of the slider, the abutment portion having an abutment surface which abuts against an abutment surface of the retaining projection of the first housing when the first connector is fitted to the second connector, wherein the abutment surface of the abutment portion and the abutment surface of the retaining projection are substantially slanting surfaces which are substantially formed along an imaginary circle having its center at the axis of flexing of the cantilever arm.

2. A half-fitting prevention connector comprising:

a first connector including a first housing having an engagement groove and a retaining projection which are provided at a front end portion of the first housing;

a second connector fittable to the first connector, the second including a second housing having an elastic lock arm, a front end of the elastic lock arm having a lock portion engageable with the engagement groove of the first housing when the first connector is fitted to the second connector;

a slider attachable to the second housing, the slider being resiliently urged in an axial direction thereof when the slider is attached to the second housing, the slider including an elastic cantilever arm; and an abutment portion formed at a front end of the cantilever arm of the slider, the abutment portion having an abutment surface which abuts against an abutment surface of the retaining projection of the first housing when the first connector is fitted to the second connector, wherein the abutment surface of the abutment portion and the abutment surface of the retaining projection are substantially formed in arc-shaped surfaces disposed along an imaginary circle having its center at the axis of flexing of the cantilever arm.

3. The half-fitting prevention connector of claim 1, wherein the slider is attached to the second housing so that the slider is received within the second housing.

* * * * *